US006799516B2

(12) United States Patent
Lucero, Sr. et al.

(10) Patent No.: US 6,799,516 B2
(45) Date of Patent: Oct. 5, 2004

(54) SMALL ALUMINUM "FIRE CUP" USED WITH A FIRE CRACKER, FOR ENTERTAINMENT PURPOSES

(76) Inventors: Joseph Patrick Lucero, Sr., 1427 Milton Rd., Basile, LA (US) 70515; Kelly Jane Lucero, 1427 Milton Rd., Basile, LA (US) 70515; Joseph Patrick Lucero, Jr., 1427 Milton Rd., Basile, LA (US) 70515; Brandon Scott Lucero, 1427 Milton Rd., Basile, LA (US) 70515

( * ) Notice: Subject to any disclaimer, the term of this patent is extended or adjusted under 35 U.S.C. 154(b) by 0 days.

(21) Appl. No.: 10/231,540

(22) Filed: Sep. 3, 2002

(65) Prior Publication Data

US 2004/0045471 A1 Mar. 11, 2004

(51) Int. Cl.[7] ..... F42B 4/04; F42B 4/06

(52) U.S. Cl. ..... 102/361; 102/343; 102/349; 102/358; 446/399; 446/212; 446/56

(58) Field of Search ..... 102/361, 335, 102/336, 341, 343, 347, 349, 358; 446/52, 56, 211, 212, 398, 399

(56) References Cited

U.S. PATENT DOCUMENTS

| | | | | | |
|---|---|---|---|---|---|
| 566,802 | A | * | 9/1896 | Rumage | 42/55 |
| 1,789,372 | A | * | 1/1931 | Scardone | 102/361 |
| 2,087,281 | A | * | 7/1937 | Achillo | 102/358 |
| 2,752,729 | A | * | 7/1956 | Macinnes | 446/399 |
| 3,882,324 | A | * | 5/1975 | Smolker et al. | 102/202.5 |
| 5,526,750 | A | * | 6/1996 | Poor et al. | 102/361 |
| 5,627,338 | A | * | 5/1997 | Poor et al. | 102/361 |
| 5,841,061 | A | * | 11/1998 | Westfall et al. | 102/361 |
| 6,286,429 | B1 | * | 9/2001 | Marietta et al. | 102/342 |
| 2004/0003744 | A1 | * | 1/2004 | Werner | 102/349 |

* cited by examiner

*Primary Examiner*—Michael J. Carone
*Assistant Examiner*—James S. Bergin

(57) ABSTRACT

A reusable aluminum fire cup having a dome-shaped cap and including an ordinary fire cracker placed in a copper tube, then placed in a container with small amount of water, and then ignited, the fire cracker's blast and the pressure from the water will propel the fire cup high into the air.

1 Claim, 4 Drawing Sheets

FIRE CUP PAGE 1

FIRECRACKER INSERTED PAGE 2

PAGE 3

PAGE 4

SMALL ALUMINUM "FIRE CUP" USED WITH A FIRE CRACKER, FOR ENTERTAINMENT PURPOSES

CROSS-REFERENCES TO RELATED APPLICATIONS

"Not Applicable"

BACKGROUND OF THE INVENTION

This invention is to be used in conjunction with a fire cracker and a bucket of water. All for the purpose of exciting entertainment.

SUMMARY

This invention is a 2½×1⅞" aluminum or hardened plastic cylinder with either a dome or a cone shaped top. The top has a ⅜"×¼" copper or hardened material tube inserted into the center. Then you would place a 1½×¼" fire cracker (preferably water dinomite) into the flared copper tube. After the cup is loaded place it in a bucket or container of choice, holding ¾" of water. Upon lighting the fire cracker, the blast will propel the Fire Cup between 60 to 80' into the air.

Some of the advantages of this invention are as follows:

a) will add excitement to any ordinary fire cracker:

b) safer than user lighting fire cracker in hand;

c) will hold user's attention much longer than a regular fire cracker;

d) Fire Cup can be used over and over again.

DRAWING FIGURES

Figure 1:
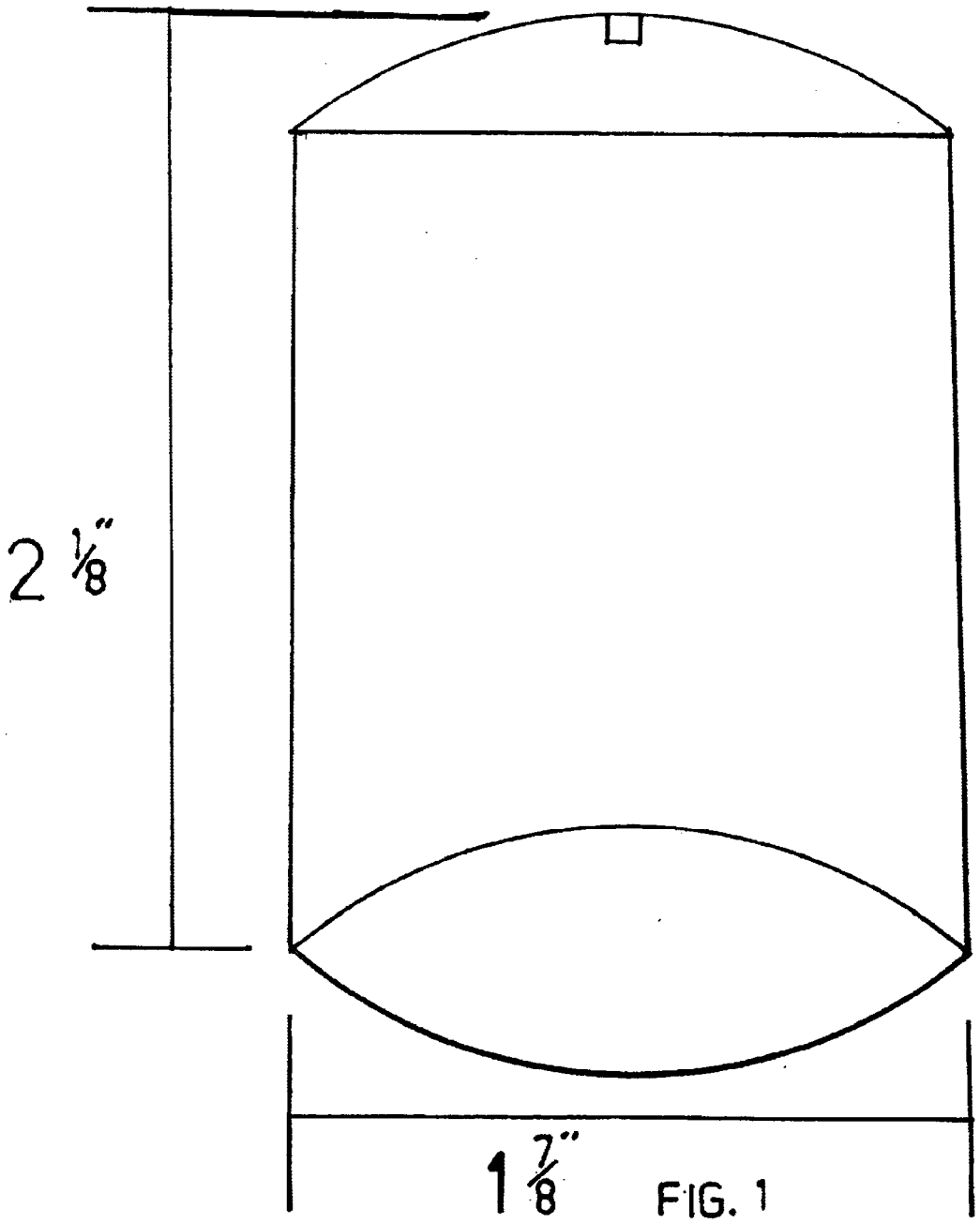

FIG. 1 shows actual dimensions of the Fire Cup 2½×1⅞"

Figure 2A:
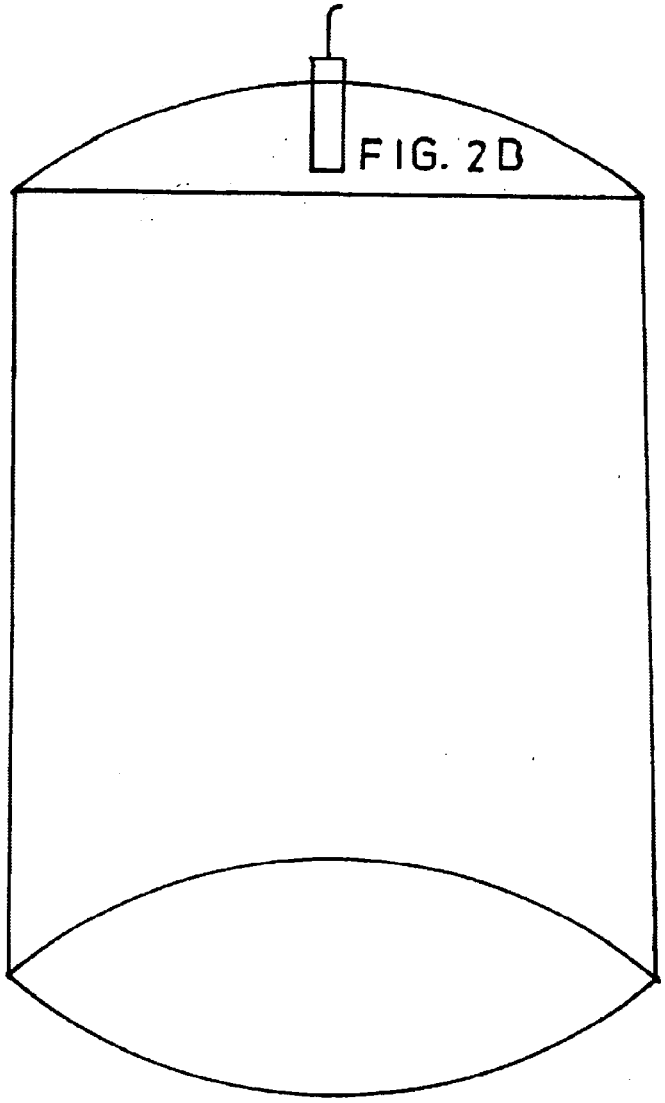

FIG. 2*a* shows basic shape of Fire Cup

FIG. 2*b* shows 1½×¼" fire cracker inserted into Fire Cup

Figure 3B:
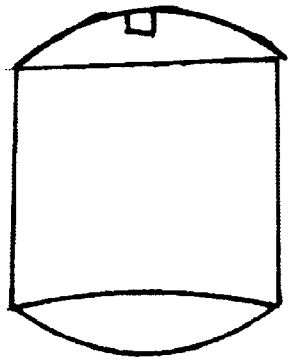
Figure 3A:
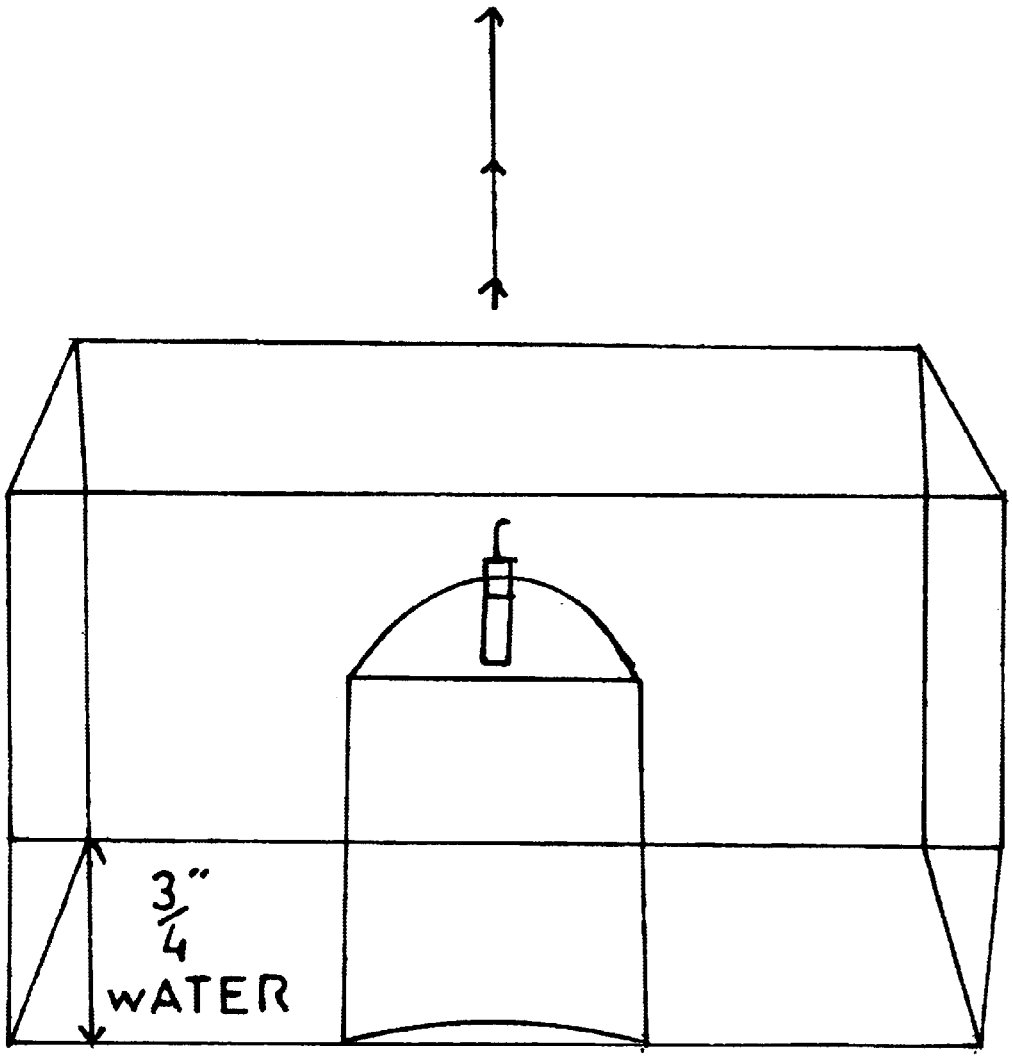
Figure 4C:
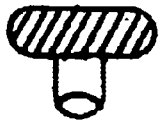
Figure 4B:
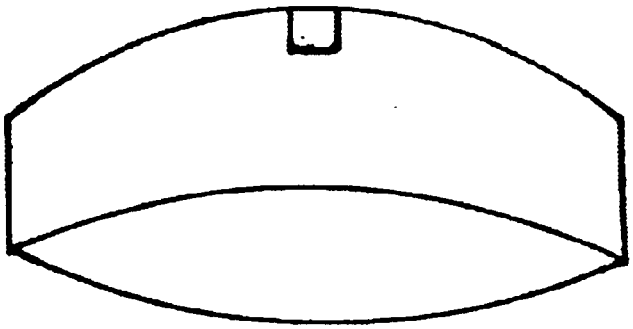
Figure 4A:
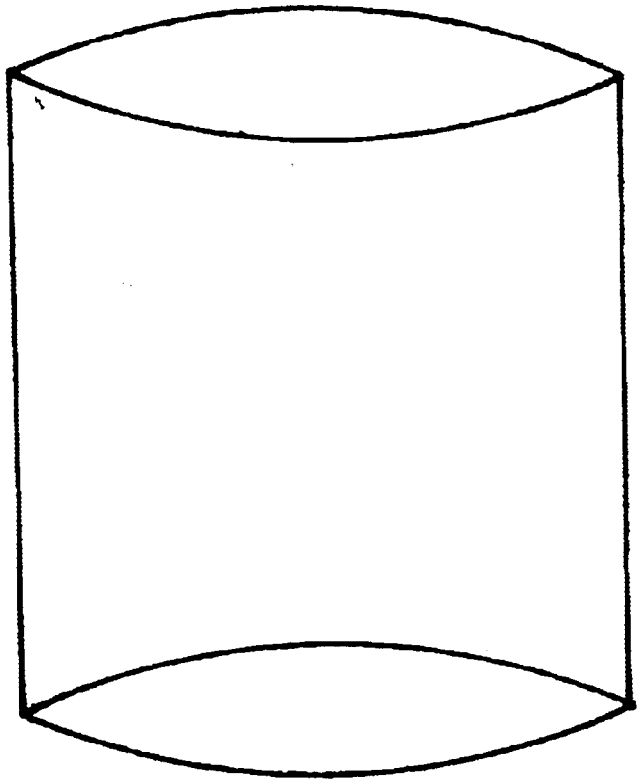

FIG. 3*a* shows Fire Cup placed in a bucket with ¾" of water and the fire cracker inserted FIG. 3*b* shows the Fire Cup propelled into air FIG. 4*a* shows 1⅞×1⅞" aluminum or other hardened plastic cylinder, which makes up the body FIG. 4*b* shows ¼×1⅞" dome or cone shaped cap that fits over the body FIG. 4*c* shows ⅜×⅛" flared copper or other hardened material tube inserted into cap

DETAILED DESCRIPTION OF INVENTION

After several weeks of experimenting on various different Types of material. A thin light weight aluminum was found to perform best: and to be the most durable. Serveral type of plastic were tried, and they all broke under the pressure of the blast. There maybe a hardened plastic in which it could be made.

After working with different types of caps the dome shaped actually worked the best. I tried a couple of cone shaped caps, but they did not work as well as the dome. I also experimented with different fire crackers; Bombers, Black Cats, Water Dynamite. The Water Dynamite always performed best.

After two months of working on this invention this is what I have to work the Best.

The Fire Cup has a height of 2⅛" and a width of 1⅞", (FIG. 1), a dome shaped cap (FIG. 4*b*), and a ⅜" flared copper tube inserted into the top of the dome (FIG. 4*c*). Now you place 1½×¼" fire cracker into the copper tube (FIG. 2*b*). At this point you can now place the Fire Cup into a bucket or container of choice with ¾" of water in the bottom (FIG. 3*a*). Once this is all done you will need a long lighter (punk) the kind used to light fire works. With arm extended away from body and face place the lighter on the wick of the fire cracker, until it is ignited. At this point back up safely away for the Fire Cup. The blast will then propel the Fire Cup 60 to 80' into the air (FIG. 3*b*).

This invention will add excitement to any ordinary 1½×¼" fire cracker. When you use the Fire Cup you not only get the loud noise of the fire cracker, you also get an exciting object soaring high into the air with the load BANG!!! Therefore making a one of a kind invention.

The Fire Cup is made of a durable and long lasting material so it can be used over and over again. The aluminum of which the Fire Cup is made is not only durable but is also light weight so it allows for a higher distance of propulltion. After the Fire Cup falls back to the ground you simply remove the fragments of the old fire cracker and load it with a new one and do it again and again, for hours of entertainment.

What is claimed is:

1. A reusable firecracker apparatus comprising a fire cup containing an aluminum cylinder with a dome-shaped cap fitting over said cylinder, an aperture in the top of said cap, a copper tube fitted into said aperture and contained within the fire cup, and a fire cracker housed within said tube, whereby the ignition of the fire cracker propels the fire cup into the air, yet allows for the reuse of the fire cup after it falls to the ground.

* * * * *